US007802826B2

(12) United States Patent
Schmitz et al.

(10) Patent No.: US 7,802,826 B2
(45) Date of Patent: Sep. 28, 2010

(54) LATCH ASSEMBLY

(75) Inventors: Chad D. Schmitz, Arlington, WA (US); Jai W. Eller, Thousand Oaks, CA (US); Richard J. LaConte, Black Diamond, WA (US); Brian Henderson, Seattle, WA (US)

(73) Assignee: R The Boeing Company, Chicago, IL (US)

( * ) Notice: Subject to any disclaimer, the term of this patent is extended or adjusted under 35 U.S.C. 154(b) by 521 days.

(21) Appl. No.: 11/704,634

(22) Filed: Feb. 10, 2007

(65) Prior Publication Data

US 2008/0191498 A1 Aug. 14, 2008

(51) Int. Cl.
*E05C 3/06* (2006.01)
*E05C 3/16* (2006.01)

(52) U.S. Cl. ..... 292/216; 292/44; 292/50; 292/54; 292/197; 292/202; 292/210; 292/304

(58) Field of Classification Search ..... 292/44, 292/45, 50, 52, 54, 197, 198, 202, 203, 210, 292/216, 304
See application file for complete search history.

(56) References Cited

U.S. PATENT DOCUMENTS

| | | | | | |
|---|---|---|---|---|---|
| 370,229 | A | * | 9/1887 | Abrams | 292/54 |
| 777,456 | A | * | 12/1904 | Wand | 292/57 |
| 2,881,021 | A | * | 4/1959 | Jacobson | 292/229 |
| 3,432,198 | A | | 3/1969 | Connor | |
| 3,647,251 | A | * | 3/1972 | Brown et al. | 292/111 |
| 3,993,339 | A | * | 11/1976 | Cherbourg et al. | 292/336.3 |
| 4,036,517 | A | * | 7/1977 | Talmadge | 292/216 |
| 4,134,281 | A | * | 1/1979 | Pelcin | 70/208 |
| 4,775,176 | A | | 10/1988 | Ikeda | |
| 4,979,766 | A | * | 12/1990 | Wasilewski | 292/52 |
| 5,064,228 | A | * | 11/1991 | Bisbing | 292/54 |
| 5,735,557 | A | * | 4/1998 | Harvey | 292/216 |
| 6,048,001 | A | * | 4/2000 | Miller et al. | 292/198 |
| 6,155,616 | A | * | 12/2000 | Akright | 292/207 |
| D543,437 | S | * | 5/2007 | Mallory et al. | D8/330 |
| 7,210,712 | B2 | * | 5/2007 | Artsiely | 292/97 |
| D543,831 | S | * | 6/2007 | Druckman et al. | D8/330 |
| 7,261,340 | B2 | * | 8/2007 | Wang et al. | 292/241 |
| 7,438,332 | B2 | * | 10/2008 | Wang et al. | 292/241 |
| 2007/0200366 | A1 | * | 8/2007 | Rozo et al. | 292/336.3 |

FOREIGN PATENT DOCUMENTS

| | | | |
|---|---|---|---|
| DE | 3532216 | A1 * | 3/1987 |
| EP | 289715 | A1 * | 11/1988 |

* cited by examiner

*Primary Examiner*—Carlos Lugo
(74) *Attorney, Agent, or Firm*—Tung & Associates

(57) ABSTRACT

A latch assembly includes at least one latch unit having a latch unit housing, a latch notch provided in the latch unit housing, a lock bracket pivotally mounted in the latch unit housing adjacent to the latch notch and positional between latched and unlatched positions and an actuating arm engaging the lock bracket; a torque shaft coupled to the actuating arm; a handle unit having a handle housing and a handle plate pivotally mounted in the handle housing and coupled to the torque shaft; and at least one position indicator lip provided on the handle plate.

15 Claims, 6 Drawing Sheets

LATCH ASSEMBLY

FIELD OF THE INVENTION

The present invention relates to latches. More particularly, the present invention relates to a latch assembly which clearly indicates open and closed positions.

BACKGROUND OF THE INVENTION

Many conventional latch assemblies, such as those which secure overhead bins in an aircraft, for example, have various drawbacks. These include, for example, lack of positive latch engagement when in a closed position; insufficient indication that a latch is in the open position; tedious installation and adjustment; and infeasibility to remove once installed. Therefore, a latch assembly is needed which avoids drawbacks of conventional latch assemblies.

SUMMARY OF THE INVENTION

The present invention is generally directed to a latch assembly. An illustrative embodiment of the latch assembly includes at least one latch unit having a latch unit housing, a latch notch provided in the latch unit housing, a lock bracket pivotally mounted in the latch unit housing adjacent to the latch notch and positional between latched and unlatched positions and an actuating arm engaging the lock bracket; a torque shaft coupled to the actuating arm; a handle unit having a handle housing and a handle plate pivotally mounted in the handle housing and coupled to the torque shaft; and at least one position indicator lip provided on the handle plate.

BRIEF DESCRIPTION OF THE DRAWINGS

The invention will now be described, by way of example, with reference to the accompanying drawings, in which.

DETAILED DESCRIPTION OF THE INVENTION

Figure 1:
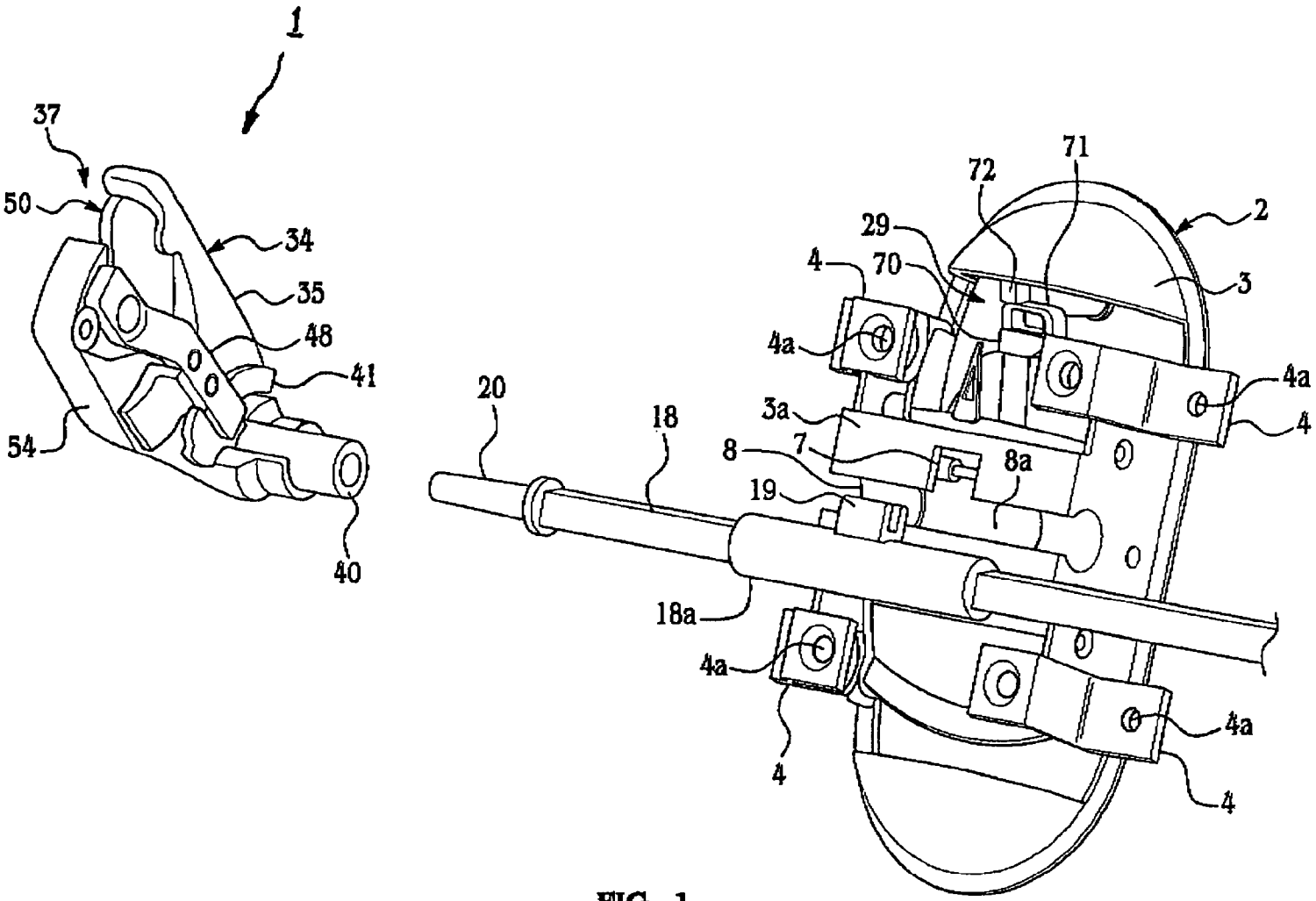
FIG. 1 is an exploded, rear perspective view of an illustrative embodiment of the latch assembly.

Referring to the drawings, an illustrative embodiment of the latch assembly is generally indicated by reference numeral 1. The latch assembly 1 is particularly suitable for latching and unlatching a door (not shown) on an overhead bin in an aircraft, for example, in such a manner that the latched or unlatched status of the door on the overhead bin is clearly indicated. However, it will be recognized and understood that the latch assembly 1 is equally suitable for latching and unlatching doors in a variety of applications.

Figure 6:
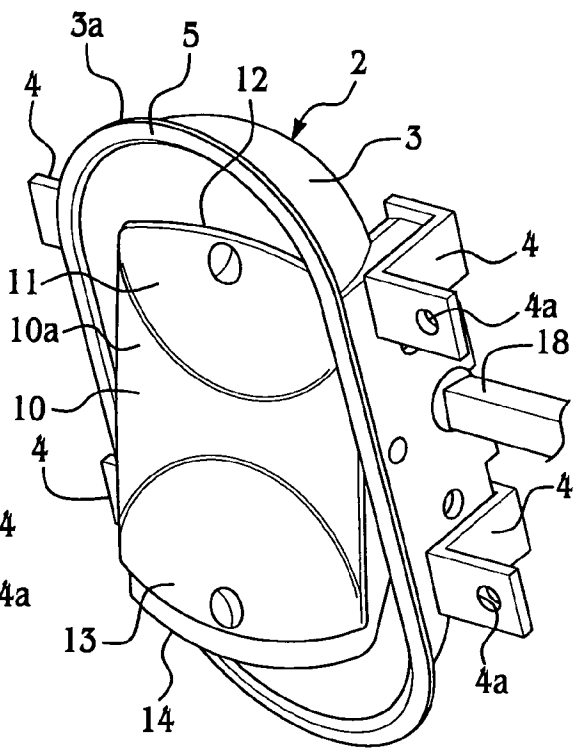
FIG. 6 is a front perspective view of a handle unit element of an illustrative embodiment of the latch assembly, with a handle plate element of the handle unit shown in an unlatched position.
Figure 5:
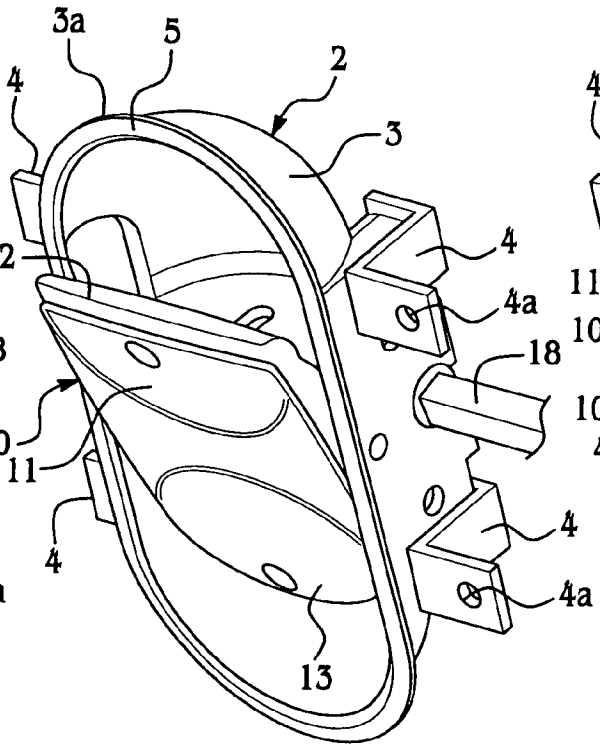
FIG. 5 is a front perspective view of a handle unit element of an illustrative embodiment of the latch assembly, with a handle plate element of the handle unit shown in an unlatched position.
Figure 4:
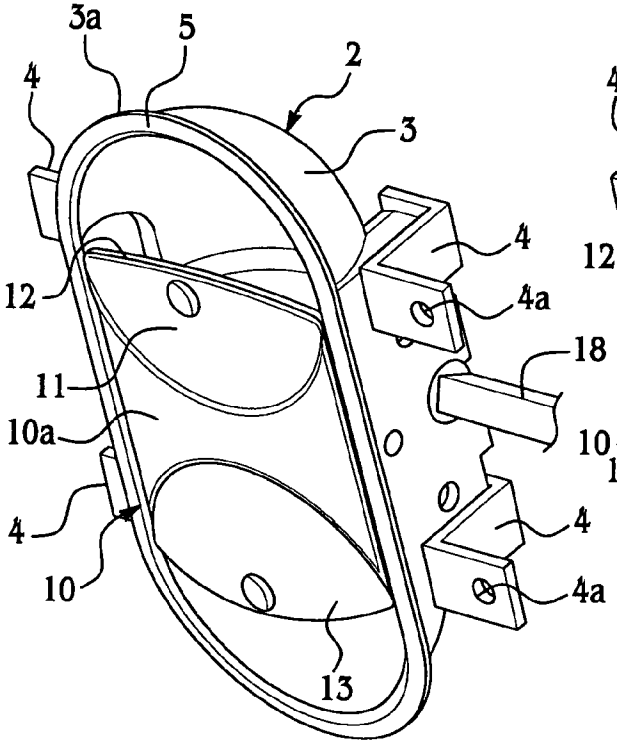
FIG. 4 is a front perspective view of a handle unit element of an illustrative embodiment of the latch assembly, with a handle plate element of the handle unit shown in a latched position.

As shown in FIG. 1, the latch assembly 1 includes a handle unit 2 which engages at least one latch unit 34, typically in a manner which will be hereinafter described, to facilitate selective latching and unlatching of the at least one latch unit 34. The handle unit 2 includes a handle housing 3. The handle housing 3 includes a housing wall 3*a* which typically has a generally elongated, elliptical, concave shape. At least one housing mount bracket 4, typically having a fastener opening 4*a*, may be provided on the handle housing 3 to facilitate attachment of the handle unit 2 to an enclosure door (not shown) of an enclosure, such as an overhead bin door on an overhead bin of an aircraft, for example, or to an alternative element which is to be latched using the latch assembly 1. As shown in FIGS. 4-6, the handle housing 3 has a housing interior 5.

As shown in FIG. 1, a cam opening 7 extends through the housing wall 3*a* and communicates with the housing interior 5 of the handle housing 3. A generally elongated, concave shaft groove 8 is provided in the housing wall 3*a*, on respective sides of the cam opening 7. An elongated torque shaft 18 extends through the shaft groove 8 and is able to freely rotate therein.

The torque shaft 18 typically has a generally rectangular or square cross-section. A tapered shaft end 20 (one of which is shown in FIG. 1) terminates at least one end of the torque shaft 18. In some embodiments of the latch assembly 1, tapered shaft ends 20 terminate respective ends of the torque shaft 18. A generally elongated, cylindrical shaft cylinder 18*a* is provided on the torque shaft 18. The shaft cylinder 18*a* fits in the correspondingly-shaped shaft groove 8 provided in the handle housing 3 of the handle unit 2. A shaft cam 19 extends from the shaft cylinder 18*a* and fits in the cam opening 7. The cam opening 7 communicates with a slot 8*a* provided in the shaft groove 8.

As shown in FIGS. 4-6, a handle plate 10 is pivotally mounted in the housing interior 5 of the handle housing 3 typically in a manner which will be hereinafter described. The handle plate 10 typically includes a plate body 10*a* having a generally elongated, rectangular shape. The plate body 10*a* of the handle plate 10 is attached to the shaft cam 19 on the torque shaft 18. Accordingly, the handle plate 10 is pivotal between unlatched positions in FIGS. 5 and 6. The handle plate 10 is shown in a latched position in FIG. 4. Pivoting of the handle plate 10 in the housing interior 5 of the handle housing 3 facilitates axial rotation of the torque shaft 18 in the shaft groove 8 of the handle housing 3 typically in a manner which will be hereinafter described.

As further shown in FIGS. 4-6, in some embodiments of the latch assembly 1, a top handle plate elevation 11 and a bottom handle plate elevation 13, each of which typically has a generally semicircular shape, protrudes from the surface of the plate body 10*a* of the handle plate 10, at respective top and bottom edges thereof. As shown in FIGS. 4 and 5, a top position indicator lip 12 extends along a top edge of the plate body 10*a*, typically adjacent to the top handle plate elevation 11. As shown in FIG. 6, a bottom position indicator lip 14 extends along a bottom edge of the plate body 10*a*, typically adjacent to the bottom handle plate elevation 13. In some embodiments of the latch assembly 1, each of the top position indicator lip 12 and the bottom position indicator lip 14 is a bright color such as red, for example. When the handle plate 10 is in the latched position shown in FIG. 4, neither the top position indicator lip 12 nor the bottom position indicator lip 14 is visible when the handle unit 2 is viewed from the front. When the handle plate 10 is in the unlatched position shown in FIG. 5, the top position indicator lip 12 is visible; when the handle plate 10 is in the unlatched position shown in FIG. 6, the bottom position indicator lip 14 is visible.

Figure 13:
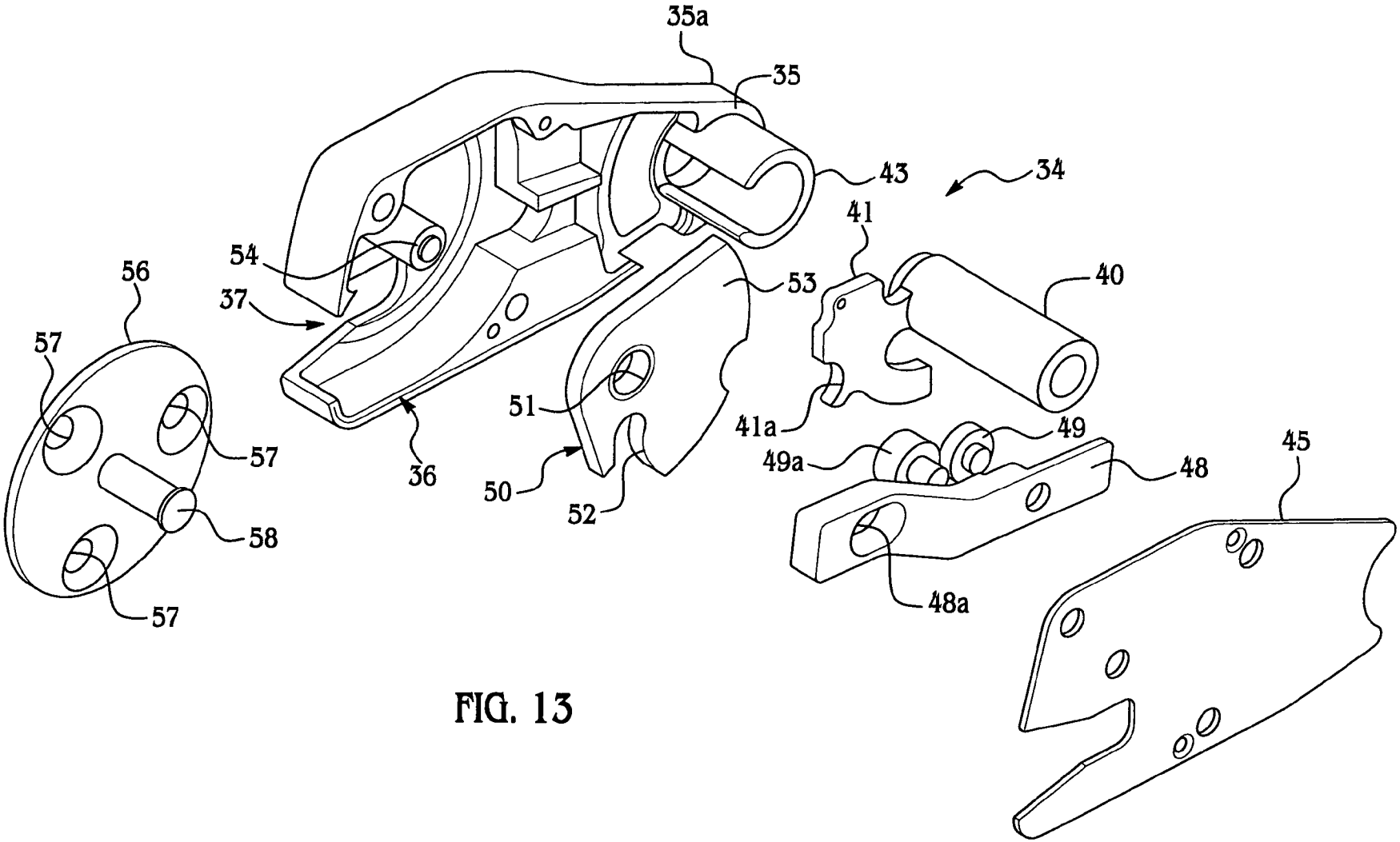
FIG. 13 is an exploded, perspective view of a latch unit element of an illustrative embodiment of the latch assembly.

As shown in FIGS. 2*a*-3*b* and 13, the torque shaft 18 (FIG. 1) engages at least one latch unit 34. In some embodiments of the latch assembly 1, the torque shaft 18 engages a pair of latch units 34. As shown in FIG. 13, each latch unit 34 includes a latch unit housing 35 having a housing wall 35*a* which may have a generally elongated shape. The latch unit housing 35 has a housing interior 36. A latch notch 37 extends through one end of the latch unit housing 35 and communicates with the housing interior 36.

A generally elongated, cylindrical pin bracket 40 receives the shaft end 20 (FIG. 1) of the torque shaft 18. The pin bracket 40 may be rotatably mounted inside a generally cylindrical pin bracket housing 43 which extends from the latch unit housing 35. A pin bracket arm 41, having an arm notch 41*a*, extends from the pin bracket 40, into the housing interior 36 of the latch unit housing 35.

Figures 2A, 2B, 3A, 3B:
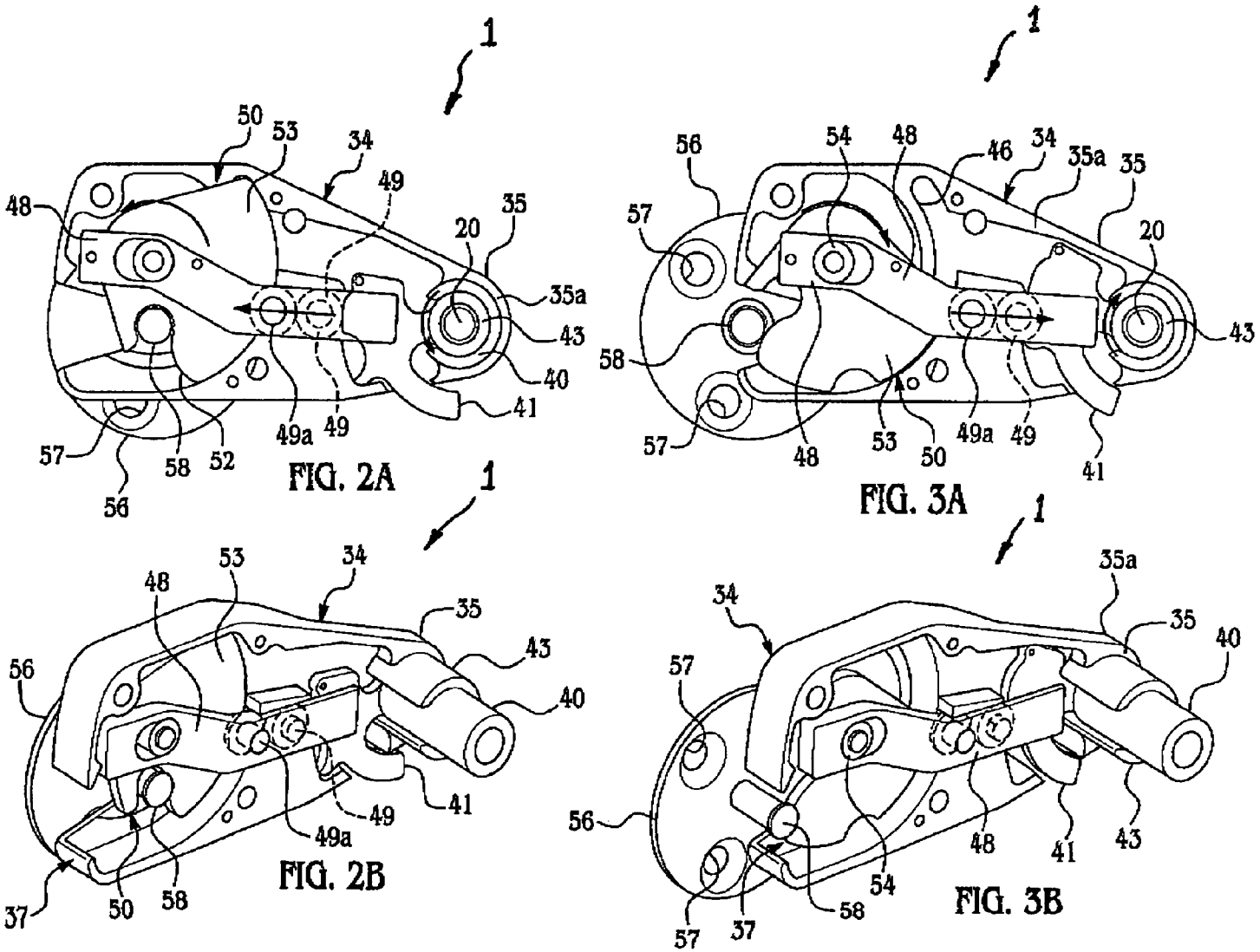
FIG. 2*a* is an interior view of a latch unit element of an illustrative embodiment of the latch assembly, shown in a latched configuration.
FIG. 2*b* is a perspective view of a latch unit element of an illustrative embodiment of the latch assembly, shown in a latched configuration.
FIG. 3*a* is an interior view of a latch unit element of an illustrative embodiment of the latch assembly, shown in an unlatched configuration.
FIG. 3*b* is a perspective view of a latch unit element of an illustrative embodiment of the latch assembly, shown in an unlatched configuration.

As shown in FIGS. 2*a*-3B, an elongated actuating arm 48 is slidably mounted on the housing interior 36 of the latch unit housing 35. A pair of arm guide pins 49, 49*a* extends from the actuating arm 48 and is slidably mounted in the housing interior 36. As shown in FIG. 3*a*, when the latch unit 34 is disposed in the unlatched configuration, the arm notch 41*a* provided in the pin bracket arm 41 receives the arm guide pin 49 on the actuating arm 48. As shown in FIG. 2*a*, when the latch unit 34 is disposed in the latched configuration, the pin bracket arm 41 pushes the arm guide pin 49 out of the arm notch 41*a*, sliding the actuating arm 48 to the left shown in FIGS. 2*a* and 3*a*.

A lock bracket 50 is pivotally mounted in the housing interior 36 of the latch unit 34. Accordingly, as shown in FIG. 13, a mount shaft opening 51 extends through approximately the center of the lock bracket 50. A lock bracket shaft 54 spans the housing interior 36 of the latch unit housing 35 and extends through a shaft opening 48*a* provided in the actuating arm 48. A latch pin notch 52 extends into an edge of the lock bracket 50. A slide arm 53 extends from the lock bracket 50. A slide arm pin (not shown) extends from the slide arm 53 and inserts into a slide arm pin slot 46 (FIGS. 3*a* and 3*b*) provided in the housing interior 36. A cover plate 45 may be provided on the latch unit housing 35 of the latch unit 34 to close the housing interior 36.

Figure 7A:
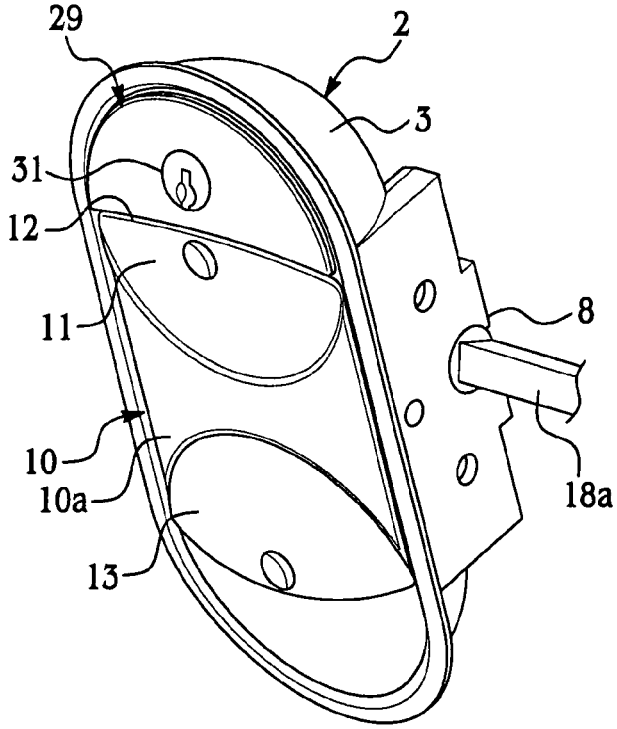
FIG. 7*a* is a front perspective view of a handle unit element of an illustrative embodiment of the latch assembly, shown in a latched and locked configuration.
Figure 7B:
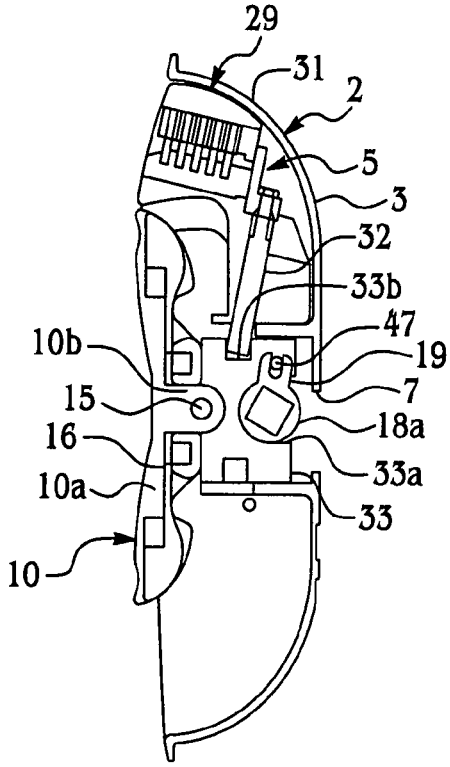
FIG. 7*b* is a sectional view of an illustrative embodiment of the latch assembly shown in a latched and locked configuration.
Figure 8:
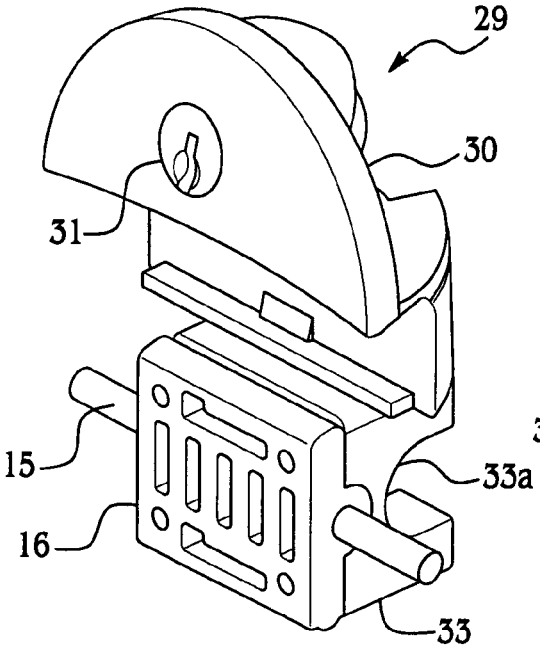
FIG. 8 is a front perspective view of a locking mechanism and lock plate elements of an illustrative embodiment of the latch assembly.
Figure 9:
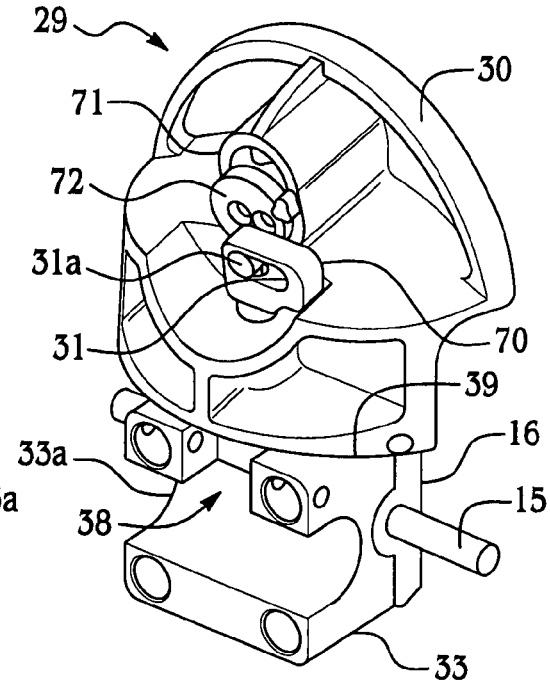
FIG. 9 is a rear perspective view of a locking mechanism and lock plate elements of the handle unit element of the latch assembly.

As shown in FIGS. 7*a*, 7*b*, 8 and 9, in some embodiments of the latch assembly 1, a locking mechanism 29 is provided in the handle housing 3 to facilitate selective locking of the handle plate 10 in the latched position shown in FIG. 4. The locking mechanism 29 typically includes a lock plate 30 which is mounted on the handle housing 3, adjacent to one end of the handle housing 3. A lock tumbler 31 is rotatably mounted in the lock plate 30. As shown in FIG. 7*b*, the lock tumbler 31 of the locking mechanism 29 includes a tumbler block 33 which is pivotally mounted in the handle housing 3. A cylinder groove 33*a* is provided in the tumbler block 33 and interfaces with the slot 8*a* (FIG. 1) provided in the shaft groove 8. As shown in FIG. 7*b*, the shaft cylinder 18*a* on the torque shaft 18 fits in the cylinder groove 33*a*. A shaft opening 33*b* is provided in the tumbler block 33 for purposes which will be hereinafter described. As shown in FIG. 9, a cam gap 38 is provided in the tumbler block 33 and communicates with the cylinder groove 33*a*. A cam pin opening 39 extends through the tumbler block 33 and communicates with the cam gap 38. The shaft cam 19 on the shaft cylinder 18*a* extends into the cam gap 38 of the tumbler block 33. As shown in FIG. 7*b*, a cam pin 47 extends through the cam pin opening 39 and engages the shaft cam 19 to couple the shaft cylinder 18*a* to the tumbler block 33 in such a manner that the tumbler block 33 rotates the shaft cylinder 18*a* and torque shaft 18 as the tumbler block 33 pivots in the handle housing 3.

As shown in FIGS. 8 and 9, a handle bracket 16, through which extends a rotatable handle pivot rod 15, engages the tumbler block 33. As shown in FIG. 7*b*, a pair of rod flanges 10*b* (one of which is shown) extends from the plate body 10*a* of the handle plate 10. The handle pivot rod 15 further extends through rod openings (not shown) provided in the respective rod flanges 10*b*. Accordingly, as the handle plate 10 is pivoted with respect to the handle pivot rod 15, the handle bracket 16 pivots the tumbler block 33 in the handle housing 3. In turn, the tumbler block 33 pivots the shaft cylinder 18*a* and torque shaft 18 since the shaft cylinder 18*a* is coupled to the tumbler block 33 through the shaft cam 19 and cam pin 47.

Figure 10:
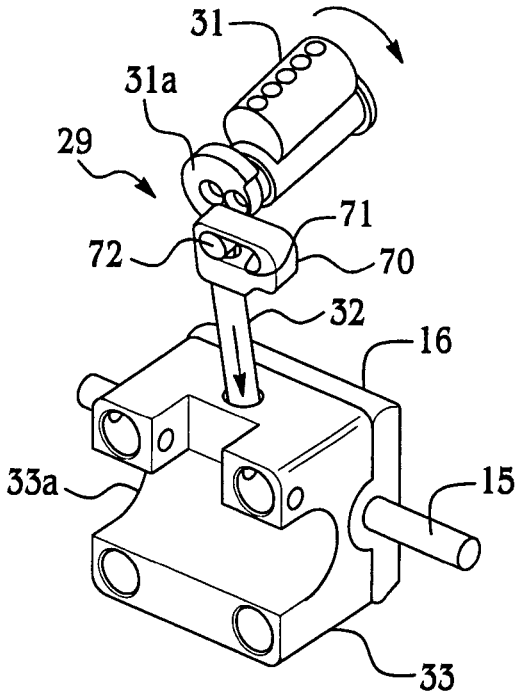
FIG. 10 is a rear perspective view of a locking mechanism element of an illustrative embodiment of the latch assembly, shown in a locked configuration.
Figure 11:
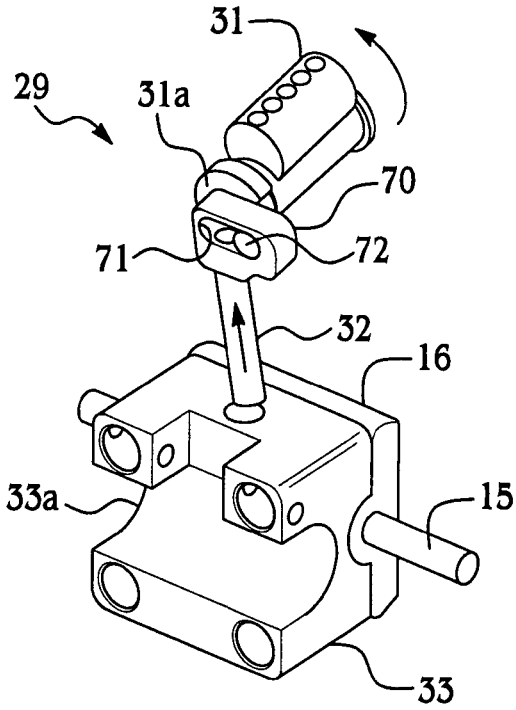
FIG. 11 is a rear perspective view of a locking mechanism element of an illustrative embodiment of the latch assembly, shown in an unlocked configuration.
Figure 12:
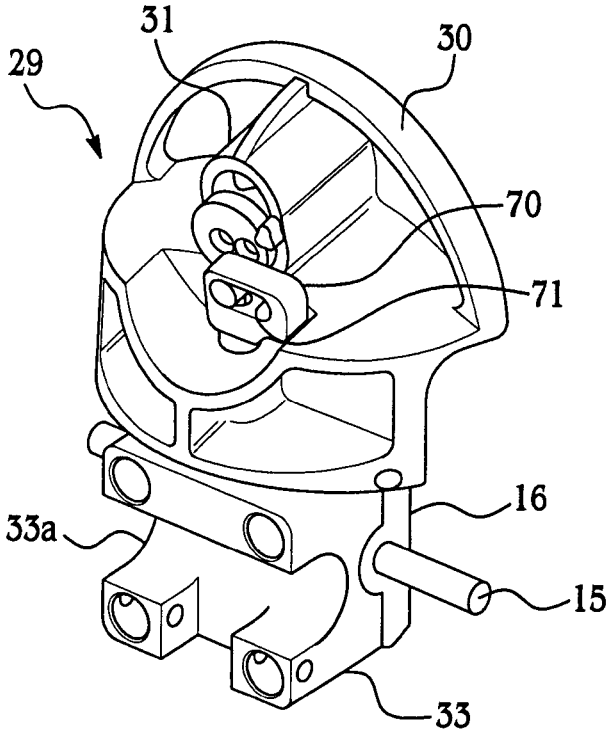
FIG. 12 is a rear perspective view of a locking mechanism and lock plate elements of an illustrative embodiment of the latch assembly.

As shown in FIGS. 10 and 11, the locking mechanism 29 further includes a tumbler bracket 70 having an elongated bracket slot 71. The lock tumbler 31 engages a tumbler cam 31*a* for rotation by the lock tumbler 31 responsive to insertion of a key (not shown) into the lock tumbler 31 and rotation of the lock tumbler 31, typically in the conventional manner. A tumbler pin 72 extends from the tumbler cam 31*a* and inserts into the bracket slot 71 of the tumbler bracket 70. A tumbler shaft 32 extends from the tumbler bracket 70. Therefore, the tumbler bracket 70 translates a rotating motion of the tumbler cam 31*a* into a reciprocating motion of the tumbler shaft 32. Accordingly, the lock tumbler 31 can be selectively positioned in the locked position shown in FIG. 10, in which the tumbler shaft 32 is inserted in the shaft opening 33*b* provided in the tumbler block 33 to prevent pivoting of the tumbler block 33 in the handle housing 3 and rotation of the torque shaft 18. The lock tumbler 31 can be selectively positioned in the unlocked position shown in FIG. 11, in which the tumbler shaft 32 is removed from the shaft opening 33*b* provided in the tumbler block 33 to facilitate pivoting of the tumbler block 33 responsive to pivoting of the handle plate 10 and rotation of the torque shaft 18.

In typical application, the handle unit 2 and at least one latch unit 34 are attached to an enclosure door (not shown) of an enclosure (not shown), such as an overhead bin door on an aircraft, for example. As shown in FIGS. 2*a*-3*b* and 13, at least one strike flange 56, from which extends a strike pin 58, is mounted on at least one interior surface (not shown) of the enclosure (not shown) the door of which is to be latched in the closed position using the latch assembly 1. The at least one strike flange 56 can be attached to the interior surface of the enclosure by, for example, extending fasteners (not shown) through respective fastener openings 57 provided in the strike flange 56 and threading the fasteners into respective fastener openings (not shown) provided in the surface. When the door of the enclosure is closed, the strike pin 58 is positioned at the opening of the latch notch 37 of the latch unit 34, as shown in FIGS. 3*a* and 3*b*.

The handle plate 10 can be manually grasped and pivoted to facilitate latching and unlatching of the latch assembly 1. When the handle plate 10 is disposed in the unlatched position shown in FIGS. 5 and 6, the position of the torque shaft 18 is such that the lock bracket 50 is in the unlatched position shown in FIGS. 3*a* and 3*b*. In the unlatched position, the enclosure door (not shown) of the enclosure can be opened and closed. Accordingly, the latch pin notch 52 of the lock bracket 50 is positioned adjacent to the strike pin 58. When the handle plate 10 is pivoted from the unlatched position shown in FIGS. 5 and 6 to the latched position shown in FIG. 4, the torque shaft 18 is rotated and the pin bracket 40 and the pin bracket arm 41 shift from the latched position shown in FIGS. 2*a* and 2*b* to the unlatched position shown in FIGS. 3*a* and 3*b*. Simultaneously, the pin bracket arm 41 shifts the actuating arm 48 to the right in the housing interior 36. Consequently, the actuating arm 48 pivots the lock bracket 50 from the latched position shown in FIGS. 2*a* and 2*b*, in which the latch pin notch 52 of the lock bracket 50 receives the strike pin 58, to the unlatched position shown in FIGS. 3*a* and 3*b*, in which the lock bracket 50 disengages the strike pin 58. Pivoting of the handle plate 10 from either of the unlatched positions shown in FIGS. 5 and 6 to the latched position shown in FIG. 4 results in the opposite movement of those components and engagement of the lock bracket 50 with the strike pin 58 in the latched position shown in FIGS. 2*a* and 2*b*. In the latched position, the enclosure door is latched in the closed position on the enclosure.

Although this invention has been described with respect to certain exemplary embodiments, it is to be understood that the specific embodiments are for purposes of illustration and not limitation, as other variations will occur to those of ordinary skill in the art.

What is claimed is:

1. A latch assembly, comprising:

one or two latch units, each unit having a latch unit housing having a latch notch;

a lock bracket, provided in each latch unit housing and movable between a latch position by engaging a corresponding striker member that is received into a corresponding latch notch and an unlatch position by disengaging the striker member, said lock bracket comprising a notch and a shaft;

a pin bracket pivotally mounted on each latch unit housing, provided with an arm having a notch;

an actuating arm having an opening at one end that receives the lock bracket shaft to move the lock bracket;

a pair of guide pins slidably mounted in the housing and received in the lock bracket notch and the pin bracket notch when the assembly is moved between the latch and unlatch positions;

a torque shaft coupled to said pin bracket;

a handle unit having a handle housing and a handle plate pivotally mounted in said handle housing and coupled to said torque shaft; such that the torque shaft pivots with the handle unit to transfer the pivotal movement and rotate the pin bracket to move said lock bracket to said unlatched position; and at least one position indicator indicating whether the latch assembly is latched or unlatched.

2. The latch assembly of claim 1 wherein said handle plate comprises a generally elongated, rectangular plate body having at least one edge and wherein said at least one position indicator is provided along said at least one edge.

3. The latch assembly of claim 2 further comprising at least one handle plate elevation provided on said handle plate.

4. The latch assembly of claim 1 further comprising at least one housing mount bracket provided on said handle housing.

5. The latch assembly of claim 1 wherein said handle housing has a generally elongated, elliptical shape.

6. The latch assembly of claim 1 further comprising a tumbler block pivotally mounted in said handle housing and wherein said handle plate engages said tumbler block and said torque shaft is coupled to said tumbler block.

7. A latch assembly, comprising:

one or two latch units, each unit having a latch unit housing having a latch notch; a lock bracket, provided in each latch unit housing and movable between a latch position by engaging a corresponding striker member that is received into a corresponding latch notch and an unlatch position by disengaging the striker member said lock bracket comprising a notch and shaft;

a pin bracket pivotally mounted on each latch unit housing, provided with an arm having notch;

an actuating arm slidably mounted in said latch unit housing; said actuating arm having an opening at one end that receives the lock bracket shaft;

a pair of guide pins slidably mounted in the housing and received in the lock bracket notch and the pin bracket notch when the assembly is moved between the latch and unlatch positions;

a torque shaft coupled to said pin bracket;

a handle unit having a handle housing and a handle plate pivotally mounted in said handle housing such that the torque shaft pivots with the handle unit to transfer the pivotal movement and rotate the pin bracket to move said lock bracket to said unlatched position;

a handle bracket carried by said handle plate;

a tumbler block pivotally mounted in said handle housing and engaged by said handle bracket;

wherein said torque shaft is coupled to said tumbler block; and at least one position indicator indicating whether the latch assembly is latched or unlatched.

8. The latch assembly of claim 7 further comprising a locking mechanism provided in said handle housing and detachably engaging said tumbler block.

9. The latch assembly of claim 8 wherein said locking mechanism comprises a lock tumbler, a tumbler cam rotatably engaged by said lock tumbler, a tumbler pin extending from said tumbler cam, a tumbler bracket having an elongated bracket slot receiving said tumbler pin and a tumbler shaft extending from said tumbler bracket and adapted to detachably engage said tumbler block.

10. The latch assembly of claim 9 further comprising a shaft opening provided in said tumbler block and wherein said tumbler shaft is adapted for removable insertion in said shaft opening.

11. The latch assembly of claim 9 further comprising a strike flange and wherein said strike pin extends from said strike flange.

12. The latch assembly of claim 7 wherein said handle housing has a generally elongated, elliptical configuration.

13. The latch assembly of claim 7 wherein said handle plate comprises a generally elongated, rectangular plate body having a pair of edges and wherein said at least one position indicator comprises a pair of position indicator lips provided along said pair of edges, respectively.

14. A latch assembly, comprising:

one or two latch units, each unit having a latch unit housing having a latch notch; having a lock bracket, provided in each latch unit housing and movable between a latch position by engaging a corresponding striker member that is received into a corresponding latch notch and an unlatch position by disengaging the striker member; said lock bracket comprising a notch and a shaft;

a pin bracket pivotally mounted on each latch unit housing;

a pin bracket arm extending from said pin bracket, having a notch;

an actuating arm slidably mounted in said latch unit housing; said actuating arm having an opening at one end that receives the lock bracket shaft;

a pair of guide pins slidably mounted in the housing and received in the lock bracket notch and the pin bracket arm notch when the assembly is moved between the latch and unlatch positions;

a torque shaft coupled to said pin bracket;

a shaft cam provided on said torque shaft;

a handle unit having a handle housing and a handle plate pivotally mounted in said handle housing such that the torque shaft pivots with the handle unit to transfer the pivotal movement and rotate the pin bracket to move said lock bracket to said unlatched position;

a tumbler block pivotally mounted in said handle housing and coupled to said shaft cam;

a handle bracket carried by said handle plate and engaging said tumbler block; and at least one position indicator indicating whether the latch assembly is latched or unlatched.

15. The latch assembly of claim 14 wherein said handle plate comprises a generally elongated, rectangular plate body having a pair of edges and wherein said at least one position indicator comprises a pair of position indicator lips provided along said pair of edges, respectively.

* * * * *